United States Patent [19]

Gaenzle

[11] Patent Number: 4,792,292

[45] Date of Patent: Dec. 20, 1988

[54] INK PUMP SYSTEM

[75] Inventor: Reinhard Gaenzle, Schaumburg, Ill.

[73] Assignee: Tampo-Tool, Inc., Shaumburg, Ill.

[21] Appl. No.: 101,372

[22] Filed: Sep. 25, 1987

[51] Int. Cl.[4] ..... F04B 23/02; F04B 39/02; B41F 31/00

[52] U.S. Cl. ..... 417/440; 418/206; 101/366

[58] Field of Search ..... 101/366; 417/440, 310; 418/47, 88, 102

[56] References Cited

U.S. PATENT DOCUMENTS

| | | | |
|---|---|---|---|
| 1,917,821 | 7/1933 | Branstrator | 418/102 |
| 2,081,906 | 6/1937 | Ball | 101/366 |
| 2,981,182 | 4/1961 | Dietrich | 418/102 |
| 3,065,693 | 11/1962 | Neal et al. | 101/366 |
| 3,430,577 | 3/1969 | Wagner | 417/440 |
| 4,009,974 | 3/1977 | Scholl | 418/206 |
| 4,400,147 | 8/1983 | Springer | 417/310 |
| 4,435,134 | 3/1984 | Okada | 417/440 |
| 4,461,209 | 7/1984 | Washehynsky | 101/366 |
| 4,573,439 | 3/1986 | Kasting | 418/206 |

OTHER PUBLICATIONS

Tampoprint Spare Parts List Automatic Ink Pump, Tampoprint GMBH, dated 7/86 pages 2–12.

*Primary Examiner*—William L. Freeh

*Attorney, Agent, or Firm*—Lockwood, Alex, FitzGibbon & Cummings

[57] ABSTRACT

An ink pump system includes an ink reservoir and an ink solvent reservoir from which solvent is controllably transferred into the ink in the reservoir so as to maintain the desired ink viscosity. The ink reservoir has an ink outlet for discharging ink to a point of consumption and an inlet into which excess ink may be recirculated to the ink reservoir. A seal-less gear pump is submerged in the ink reservoir. The pump includes a housing with an inlet communicating with the interior of the ink reservoir so as to receive ink from the ink contents in the reservoir. The pump housing also has a discharge outlet communicating with the ink outlet of the reservoir. The power source for drawing the recirculating gear pump can also be used to drive a paddle which stirs the ink in the reservoir.

10 Claims, 3 Drawing Sheets

INK PUMP SYSTEM

BACKGROUND AND SUMMARY OF THE INVENTION

The present invention relates generally to pumps, and, more particularly, to innovations and improvements which provide an ink pump system that maintains a substantially uniform ink viscosity and utilizes a gear pump without seals which is submerged within the ink reservoir and is self-lubricated by the ink of the system.

In ink pump systems, it is desirable to maintain the ink used in the system and contained in the ink reservoir at a substantially uniform viscosity. This can be accomplished by monitoring the viscosity of the ink contained in the ink reservoir and adding thinner or solvent from a solvent reservoir to the ink as necessary to maintain the ink's viscosity at a predetermined substantially constant value.

In a known prior ink pump system, a gear pump for pumping and circulating the ink to the desired location for a printing application was located externally from the ink reservoir. The external gear pumps of the prior art system have been subject to one recognized problem in that the seals of these external pumps begin to leak after a relatively short period of operation. This leakage is apparently due to the deleterious effect of the solvent in the ink on the pump seals.

The ink pump system of the present invention overcomes the aforementioned problem by utilizing a new design of a gear pump designed to be submerged in the ink reservoir. The seals of the gear pump are omitted and the pump is specifically designed so that the ink is used as a lubricant for the rotation of the gear shafts. The pump further utilizes a layer of ink to suspend the gears between the top and bottom surfaces of the pump chamber in order to reduce wear.

BRIEF SUMMARY OF THE INVENTION

The ink pump system of the present invention includes a frame having an ink reservoir mounted thereon which incorporates a gear pump submerged therein. A solvent reservoir is also mounted on the frame. Transfer and control means of known type are provided for monitoring the viscosity of the ink in the reservoir and transferring solvent from the solvent reservoir to the ink reservoir as required to maintain the ink's viscosity at a substantially constant predetermined value. The gear pump housing includes a fluid pumping chamber therein having inlet and outlet openings. A driven gear is rotatably mounted within the pumping chamber. A drive gear is also rotatably mounted within the pumping chamber and drives the driven gear. Means for driving the drive and driven gears is also provided whereby the gears rotate in opposite directions in order to pump fluid ink through the chamber from the inlet opening of the chamber to the outlet opening of the chamber and then through the ink reservoir outlet orifice.

It is a general object of the present invention to provide an improved ink pump system wherein the problem of deteriorating pump seals is eliminated.

Another object of the present invention is to provide an ink pump system in which a gear pump system is submerged in an ink reservoir.

Another object of the present invention is to provide a gear pump system having no seals and which utilizes the ink being pumped through the system as a lubricant.

Another object of the present invention is to provide an ink pump system in which the color of ink being pumped can be quickly and easily changed.

These and other objects, features and advantages of the present invention will be clearly understood and to those skilled in the art through consideration of the following detailed description.

BRIEF DESCRIPTION OF THE DRAWINGS

In the course of this description, reference will be made to the attached drawings in which.

DESCRIPTION OF THE PREFERRED EMBODIMENT

Figure 1:
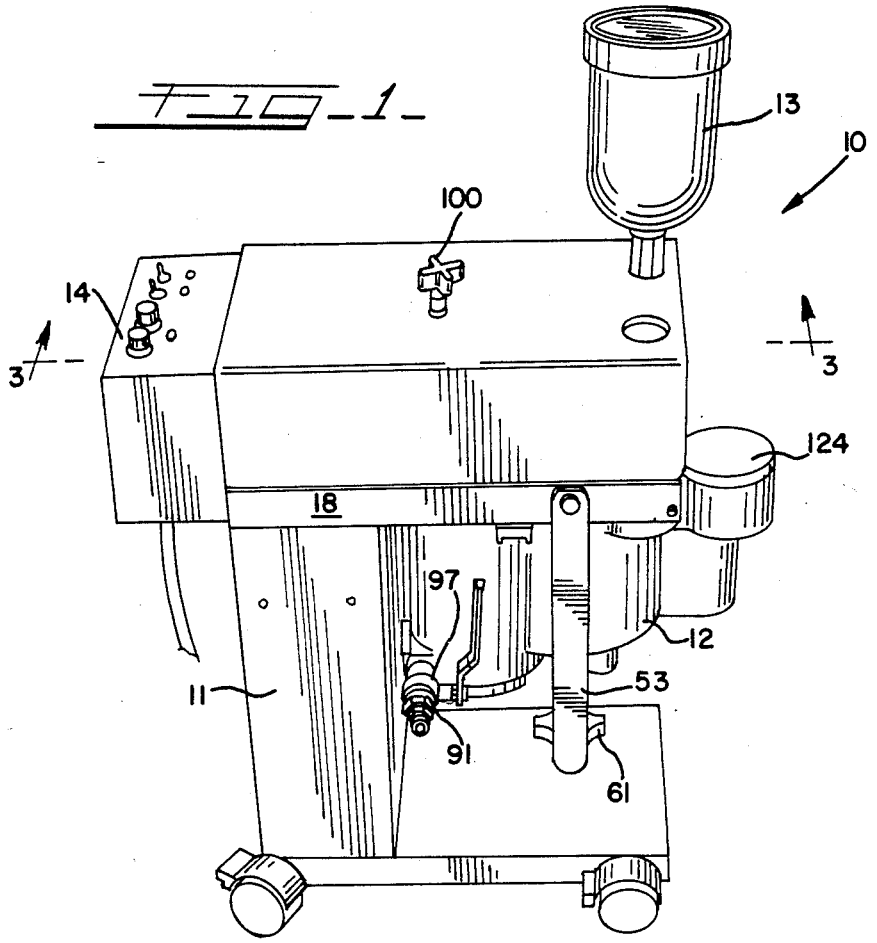
FIG. 1 is a perspective view of an ink pump system incorporating the present invention.

An overall perspective view of the ink pump system of the present invention, indicated generally at 10, is shown in FIG. 1. The ink pump system includes a chassis or frame 11 on which an ink reservoir 12 and a solvent or thinner reservoir 13 are mounted. A control system 14 of known type monitors the viscosity and controls the automatic addition of thinner to the ink reservoir in order to maintain the ink contained therein at a predetermined relatively constant viscosity. A drive system, indicated generally at 15, (FIGS. 2 and 3) is used for pumping and stirring the ink.

The drive system 15 includes a motor 17 having an upwardly extending output shaft 20 which is coupled to an extension drive shaft 21 by a coupling 22 of known type. Extension shaft 21 is journaled for rotation on chassis 11 in bearings 23—23 mounted on plate 18. A first larger lower pulley 24 is securely fixed to extension shaft 21 for rotation therewith. A second relatively smaller upper pulley 25 is also securely fixed to extension shaft 21 and is positioned above larger pulley 24.

Figure 8:
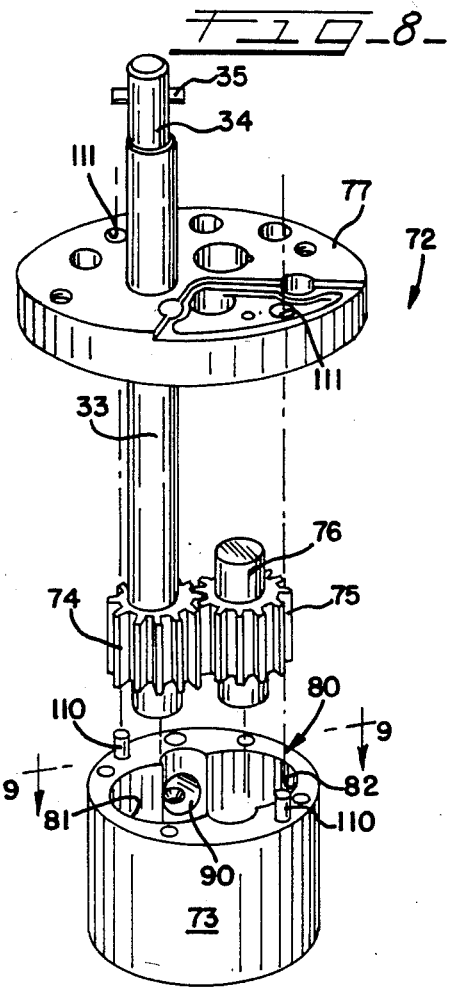
FIG. 8 is an exploded perspective view of the gear pump of FIG. 5.

The relatively larger lower pulley 24 drives a gear pump drive pulley 26 by means of a belt 27. Gear pump drive pulley 26 is securely fixed to upper pump drive shaft 30 which is rotatably mounted on plate 18 through the use of bearings 31—31. The bottom of upper pump drive shaft 30 is provided with an axial bore 32 and a pair of diametrically opposed, vertically extending, engagement slots (not shown). Lower pump drive shaft 33 has an upper portion 34 (FIG. 8) of reduced diameter which is dimensioned to telescopically mate within the bore 32 in the lower end of upper pump drive shaft 30. This reduced diameter portion 34 is provided with a horizontal bore into which a dowel pin 35 is secured. When the pump system is assembled for operation, the projecting ends of pin 35 slide into the above-mentioned diametrically opposed, vertically extending slots which extend up from the bottom of upper pump drive shaft 30. The mating of the ends of pin 35 with the slots prevents relative rotation between upper pump drive shaft 30 and lower pump drive shaft 33 thereby coupling shafts 30 and 33.

The smaller upper pulley 25 drives the ink paddle drive pulley 36 by means of a belt 37. Pulley 36 is securely fixed to upper paddle drive shaft 40 which is rotatably mounted on plate 18 by means of bearings 41—41. The bottom of upper paddle drive shaft 40 has an upwardly extending bore 42 similar to bore 32 of upper pump drive shaft 30. Bore 42 is similarly provided with a pair of diametrically opposed, vertically extending, engagement slots (now shown) such as those extending upward from the bottom of shaft 30.

Lower paddle drive shaft 43 also has an upper portion 44 of reduced diameter which telescopically mates within bore 42 of upper paddle shaft 40. The reduced diameter portion 44 has a horizontal bore through which a dowel pin (not shown), similar to pin 35 of shaft 33, is inserted. When the ink pump reservoir 12 is in its assembled position on plate 18 of chassis 11, the reduced diameter portion 44 and the horizontal pin mounted therethrough mate with bore 42 and the axially extending slots, respectively, of upper paddle drive shaft 40 thereby coupling shafts 40 and 43. Through such a construction, rotation of paddle drive pulley 36 drives upper paddle drive shaft 40 which in turn drives lower paddle drive shaft 43 with no relative rotation between shafts 40 and 43.

Figure 2:
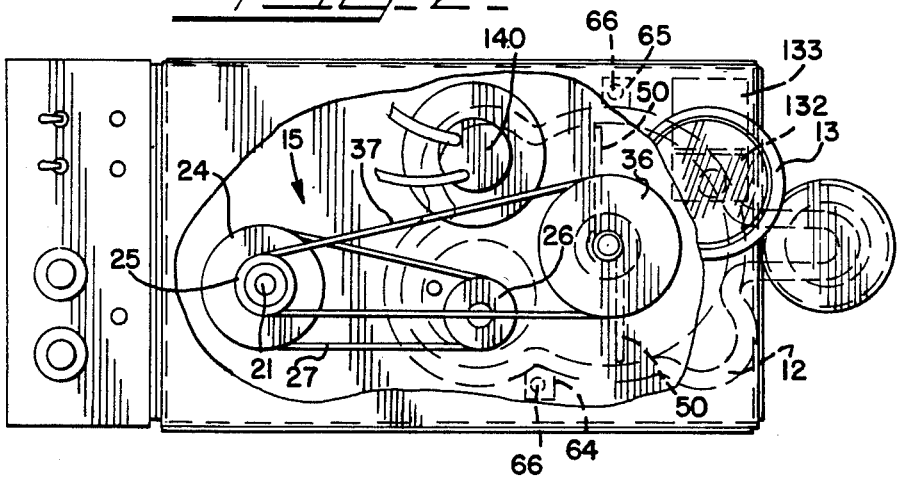
FIG. 2 is a top plan view of the ink pump system of FIG. 1, partly broken away, with certain parts removed.
Figure 3:
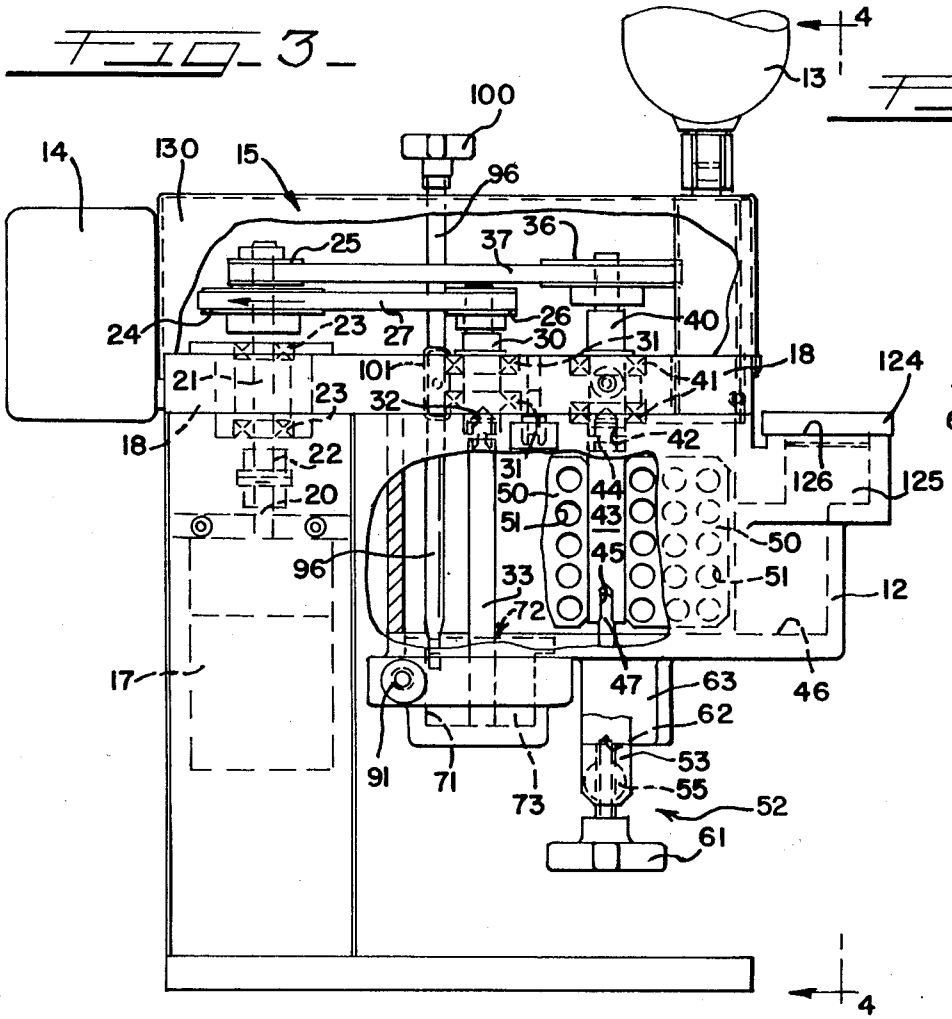
FIG. 3 is an elevation view of the ink pump system of FIG. 1, taken on line 3—3 of FIG. 1, partly broken away and partly in section.
Figure 6:
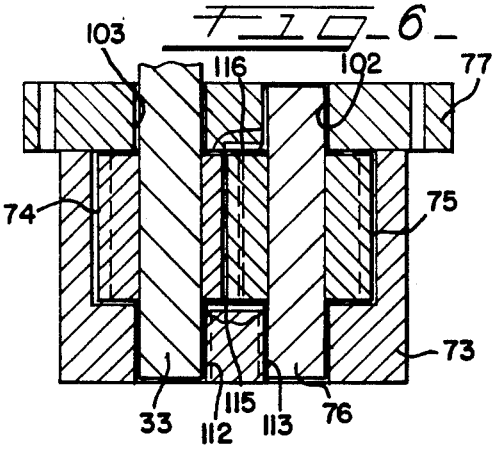
FIG. 6 is a vertical section of the gear pump taken on line 6—6 of FIG. 5.

The bottom of lower paddle drive shaft 43 is provided with an upwardly extending countersunk bore 45 (FIG. 3). The bottom 46 of ink pump reservoir 12 has an upwardly extending hardened pivot pin 47 positioned coaxially with the axis of rotation of paddle shafts 40 and 43 and constructed so that lower paddle drive shaft 43 rotates thereon. Two paddle blades 50—50 are fixed to lower paddle drive shaft 43 so that the planes of each blade are parallel but are positioned at a location offset from the axis of rotation of shaft 43 (FIG. 2). Improved mixing of the ink and solvent is accomplished by forming a plurality of holes 51 in blades 50 through which ink and solvent may pass when the paddles are rotated.

Since the lower pulley 24 is larger than gear pump drive pulley 26, gear pump drive pulley 26 together with coupled pump shaft sections 30 and 33 rotate faster than motor drive shaft 20. Conversely, because upper pulley 25 is smaller than paddle drive pulley 36, the paddle assembly rotates slower than motor shaft 20. By changing the diameters of the various pulleys, the rotational speed of the paddle system relative to that of the gear drive system may be adjusted in known manner.

Figure 4:
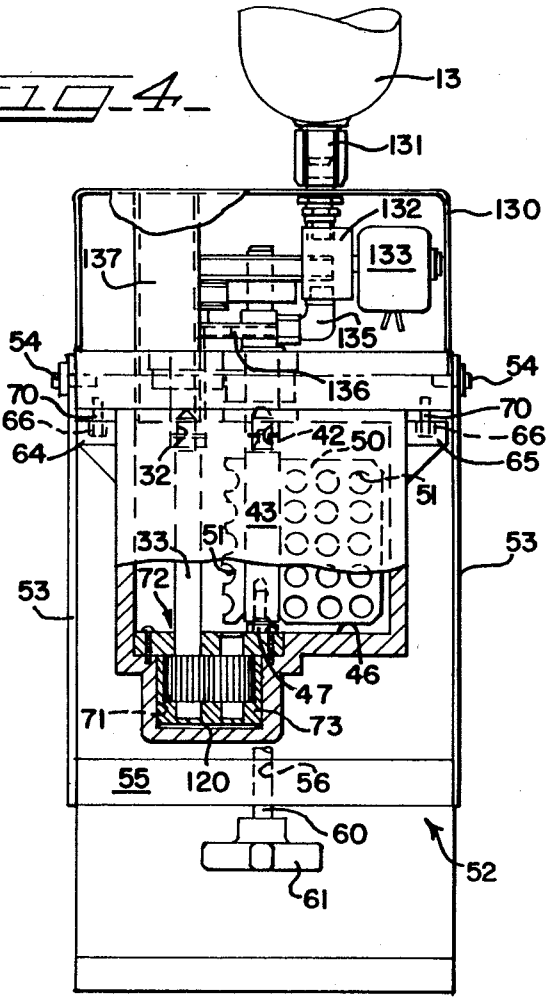
FIG. 4 is an elevation view taken on line 4—4 of FIG. 3, partly in section.

Ink reservoir 12 is removably mounted to plate 18 of chassis 11 through the use of a pivotable U-shaped sling assembly, indicated generally at 52 (FIG. 4). Sling 52 has two flat vertical strap members 53—53 that are pivotally mounted at their upper ends to opposite sides of plate 18 by means of bolts 54. A piece of tubing 55 rigidly interconnects the bottom ends of the straps 53. Tubing 55 is provided mid-way between its ends with a threaded bore 56 into which a threaded rod 60 having a handle 61 is screwed. Due to the weight of tubing 55 and handle 61, the sling assembly 52 normally depends vertically downward. By rotating handle 61 in the appropriate predetermined direction, threaded rod 60 can be moved upward or downward to engage or disengage a socket 62 (FIG. 3) in a downwardly depending portion 63 of ink reservoir 12. Through such a construction, reservoir 12 is securely supported in upward engagement against the underside of plate 18 with provision for easy disengagement and removal.

Accurate re-positioning of ink reservoir 12, and thus re-alignment of lower pump drive shaft 33 with upper pump drive shaft 30 and lower paddle drive shaft 43 with upper paddle drive shaft 40 is accomplished through the use of a pair of apertured ears or lugs 64 and 65 (FIG. 2) located on opposite sides of ink reservoir 12. Each lug has a bore with a bushing 66 fixed therein. A pair of downwardly depending dowels 70—70 (FIG. 4) are fixed to plate 18 of chassis 11 and each is constructed and arranged to mate with a bushing 66 of a lug 64 or 65 when the ink reservoir 12 is properly aligned.

The ability to quickly and easily remove the ink reservoir 12 and replace it with another is desirable because such a capability facilitates rapid changeover from one color or type of ink to another. Since most of the solvents used with the inks typically pumped with this system are heavier than air, the ink reservoirs 12 can be stored filled with ink and the reservoir located on plate 18 can be easily replaced as desired.

The bottom of ink reservoir 12 has a gear pump well or sump 71 (FIGS. 3 and 4) in which a gear pump, indicated generally at 72, is located. Gear pump 72 pumps ink from reservoir 12 through itself and out of reservoir 12 through an opening 97 (FIG. 1) in the reservoir wall to an external valve 91. A hose (not shown) or other suitable conduit is attached to valve 91 to convey the ink to the desired printing location. The ink is returned from the printing location to the ink pump system 10 in known manner into the ink-return tube.

Figure 7:
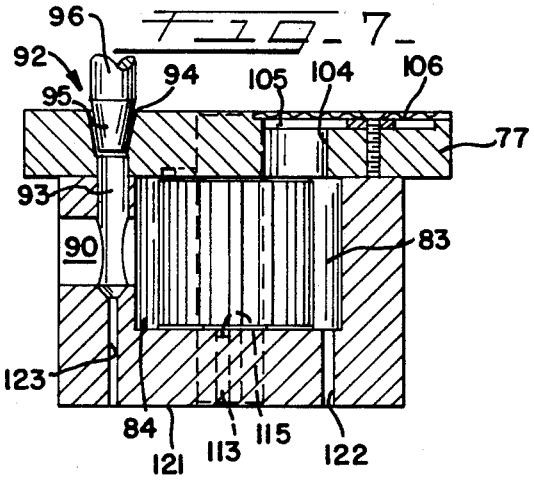
FIG. 7 is a vertical section of the gear pump taken on line 7—7 of FIG. 5.
Figure 9:
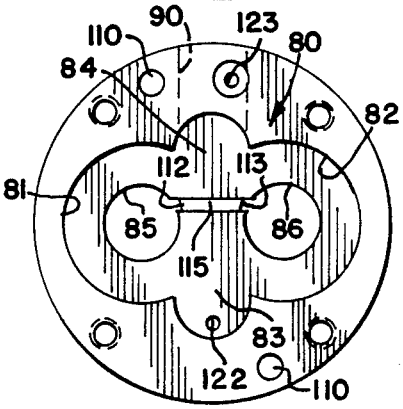
FIG. 9 is a top plan view of the gear housing portion of the gear pump taken on line 9—9 of FIG. 8.

Gear pump 72 (FIGS. 6–9) includes a gear body or housing 73, a drive gear 74 fixedly mounted on lower pump shaft 33, a driven gear 75 fixedly mounted on driven gear shaft 76 and end or cover plate 77. Gear housing 73 has a pumping chamber 80 which includes a drive gear cavity 81 and a driven gear cavity 82, each being dimensioned to receive drive gear 74 and driven gear 75, respectively. Housing 73 is further provided with a pair of bores 85 and 86 (FIG. 9) for rotatably receiving the lower portion of shafts 33 and 76, respectively. Cavities 81 and 82 are dimensioned so that the rotation of gears 74 and 75 create, in known manner, an area of reduced pressure at inlet chamber 83 and an area of increased pressure at outlet chamber 84. This pressure differential causes ink to be pumped from the inlet chamber 83 to the outlet chamber 84. An outlet port 90 (FIG. 7) in housing 73 is in fluid flow communication with outlet chamber 84. As ink is pumped by the gear pump 72, it exits outlet port 90 and passes through an opening 97 (FIG. 1) in the ink pump reservoir wall provided with external valve 91.

A bypass valve assembly 92 (FIG. 7) in the form of a needle valve is provided in gear pump 72 in order to regulate the flow of ink bypassing outlet port 90 and flowing back directly into ink reservoir 12. The tapered seat 94 of bore 93 receives the frusto-conically shaped tip 95 of bypass flow adjustment rod 96 to create the needle valve. Since bypass valve bore 93 opens directly into the ink reservoir 12, which is at a relatively low pressure, a portion of the ink tends to travel back into the ink reservoir through the bypass valve bore 93 rather than through outlet port 90 to the remote printing site. By adjusting the clearance between the tip 95 and tapered seat 94, the percentage of the total flow rate of the ink which passes through bypass valve assembly 92, and thus also the amount which passes through outlet port 90, can be easily adjusted.

Bypass flow adjustment rod 96 is vertically positioned within the ink pump system 10 as shown in FIG. 3. Bypass flow adjustment rod 96 has a handle 100 securely fixed to its top end and an externally threaded sleeve 101 securely mounted near its center portion. Plate 18 has a similarly threaded bore (not shown) which receives the sleeve 101 so that the rotation of handle 100 raises and lowers the top 95 and thereby controls the vertical height of flow adjustment rod 96 and thus the flow rate of the ink passing through the bypass valve assembly 92.

Figure 5:
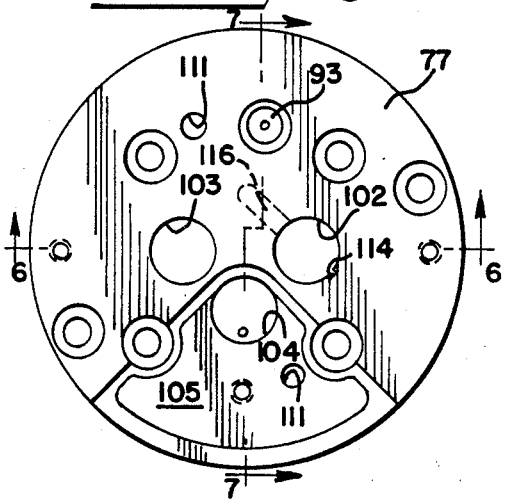
FIG. 5 is a top plan view of the gear pump incorporated in the ink pump system of FIG. 1.

End plate 77 is provided with a pair of shaft receiving bores 102 and 103 (FIG. 5). Bore 102 is dimensioned to rotatably receive the upper end of stub shaft 76 and bore 103 is dimensioned to rotatably receive lower pump shaft 33. Inlet port 104 (FIGS. 5 and 7) is located in end plate 77 such that when the end plate and housing 73 are assembled, at least a portion of inlet port 104 is positioned over inlet chamber 83. Inlet port 104 is located at the tip of a sector or pie-shaped recess 105 located in the top of end plate 77. A relatively large mesh sector-shaped screen or filter 106 (FIG. 7) is secured to end plate 77 over the recess 105 by a screw and interacts with recess 105 to provide a large filtered inlet area in order to minimize the impedance caused by debris trapped by the filter 106 so as to maintain constant flow of ink into inlet port 104 of pump assembly 72.

End plate 77 is accurately aligned in housing 73 through the use of dowel pins 110 (FIG. 8) protruding upwardly from housing 73 which mate with bores 111 in end plate 77. End plate 77 is then secured to housing 73 by screws (not shown) or other known fastener means.

In order to allow lower pump drive shaft 33 to rotate without binding, its lubricating and support assemblies must be coaxial. Thus, when end plate 77 is mounted on housing 73, bores 86 and 102, in which shaft 76 rotates, must be coaxial.

Lower pump drive shaft 33 presents a somewhat different alignment problem because shaft 33 is driven by upper pump shaft 30. If bore 103 were used as part of the lubricating assembly of shaft 33, bores 85 and 103 of gear pump assembly 72 and bore 22 in upper pump shaft 30 would have to be coaxial. In order to require only the coaxial alignment of two bores, 85 and 32, bore 103 is slightly larger than bore 85 so that the clearance between bore 103 and shaft 33 is slightly larger than the clearances between bore 85 and shaft 33 and bores 86 and 102 with shaft 76, respectively.

Rather than utilizing bearings for supporting shafts 33 and 76 for rotation and in order to eliminate the need for seals, gear pump 72 utilizes the ink of the ink pump system 10 to self-lubricate the rotation of shafts 33 and 76 within housing 73. Due to the relatively poor lubricity of many inks, certain modifications have been made to provide efficient and extended operation of the gear pump 72. Thus, vertical ink carrying channels 112, 113 and 114 are provided in bores 85, 86 and 102, respectively, to maintain proper lubrication between the bores and the respective shafts which rotate therein. By providing channels or grooves 112, 113 and 114, ink flows through these channels and a layer of ink is maintained around the circumference of each bore thus lubricating the bores and shafts turning therein in a manner similar to a journal bearing. By way of example, it has been found that when using shafts 33 and 76 having diameters of 0.500 inches and bores 85, 86 and 102 range in diameter from 0.501 to 0.502 inches, the channels or grooves 112, 113 and 114 function properly if their cross-section has a radius of 0.03125 inches.

In order to maintain the axial position of the gear and shaft assemblies within pumping chamber 80 and thus prevent the top or bottom surfaces of gears 74 and 75 from contacting the top or bottom, respectively, of pumping chamber 80, housing 73 and end plate 77 have been provided with horizontal channels or grooves. Thus, bottom portion of pumping chamber 80 has a horizontal channel or groove 115 (FIG. 9) which connects channel 112 of bore 85 with channel 113 of bore 86. Since channel 115 is on the high pressure side of pumping chamber 80, ink of relatively high pressure will be forced into the channel 115. Ink which is so forced will provide an axially directed upward force on gears 74 and 75 thus forcing them away from the bottom surface of pumping cavity 80 and preventing wear between the lower surface of cavity 80 and the bottoms of gears 74 and 75. As an example, when shafts 33 and 76 as dimensioned above have spur gears 74 and 75 mounted thereon and the shafts are located in bores 85 and 86 as dimensioned above and the bores have their axes 0.938 inches apart, it has been found that a channel 115, 0.035 inches deep and 0.0625 inches wide functions properly.

Likewise, to prevent gears 74 and 75 from contacting the underside of end plate 77, an equal but opposite, downwardly directed, axial force must also be applied to gears 74 and 75. The downwardly directed, axial force on gear 75 is generated through the use of a horizontal channel or groove 116 (FIG. 5) which is located in the lower surface of end plate 77. As with channel 115, horizontal channel 116 is located on the high pressure side of pumping cavity 80 and thus, as with channel 115, the high pressure ink is forced into channel 116 to provide a downwardly directed, axial force on gear 75. As a further example, for the shaft 76, gear 75 and bore 102 as dimensioned above, channel 116 functions properly if constructed 0.0625 inches deep and 0.125 inches wide.

The downwardly directed, axial force on gear 74 is provided, at least in part, by the ink leakage flow through the clearance between the shaft 33 and bore 103. The additional length of lower pump drive shaft 33 compared to that of shaft 76 provides additional weight and thus also provides an additional downwardly directed, axial force. The effect of these upwardly and downwardly directed axial forces on gears 74 and 75 is to provide a floating effect which prevents gears 74 or 75 from contacting the upper or lower portion of chamber 80 and thus minimizes wear on the gears and the chamber. When utilizing shaft 33 with a diameter of 0.500 inches, it has been found that a bore 103 having a diameter of 0.515 inches functions properly.

In order to maintain the proper lubrication for the lower portions of lower pump shaft 33 and shaft 76 in bores 85 and 86, respectively, ink should be constantly flowing through channels 112 and 113. A small opening or gap 120 (FIG. 4) is thus provided between the bottom 121 (FIG. 7) of housing 73 and the opposing bottom surface of gear pump well 71. A small return flow bore 122 is provided through housing 73 that extends from pumping chamber 80 to the bottom 121 of housing 73. Since notches 112 and 113 are located on the high pressure side of the gear pump and the return flow bore 122 is located on the low pressure side, a relatively continuous flow down through channels 112 and 113 int gap 120 and up through bore 122 is maintained. As an example, it has been found that using a return flow bore 122 having a diameter of 0.09 inches functions properly.

An emergency bypass passage 123 (FIG. 7) extends downwardly from the outlet port 90 to the bottom 121 of housing 73. In the event that both the bypass flow adjustment valve 92 and the external discharge valve 91 are closed, operation of the gear pump 72 will not damage the motor 17 or gear pump 72 because the flow will pass through emergency bypass passage 123 into gap 120 and back up through return flow passage 122. Emergency bypass passage 123 is dimensioned such that very little ink will flow therethrough unless both the external discharge valve 91 and the bypass flow adjustment valve 92 are closed sufficiently so that a danger of motor or gear pump damage is present. Again, as an example, it has been found that an emergency bypass passage 123 having a diameter of 0.09 inches functions properly.

If increased pumping capacity is desired, a plug or screw (not shown) can be inserted into bypass passage 123 in order to prevent any flow therethrough. In the event such a plug is used, it is desirable to provide some type of mechanism to prevent the closure of both external valve 91 and bypass valve 92 when motor 17 is operating.

Solvent reservoir 13 is mounted on hood 130 (FIG. 4). Solvent is fed by gravity through the discharge end 131 of reservoir 13 to valve 132 which is actuated by solenoid 133. When additional solvent is required in the ink reservoir 12 in order to maintain the ink within the ink reservoir at a desired viscosity, an appropriate signal is sent from control system 14 to solenoid 133, thus opening valve 132. Solvent passes through elbow 135 into horizontal tubing 136 and then through ink return pipe 137 into ink reservoir 12. By maintaining valve 132 in a closed position, solvent flow into the ink reservoir is prevented.

A viscosimeter 140 (FIG. 2) of known type is mounted on plate 18 and depends downward into ink reservoir 12. The viscosimeter 140 operates in known manner to monitor the viscosity of the ink contained within the ink reservoir and produces a signal which is sent to the control system 14. When the viscosity of the ink contained within the reservoir falls below a predetermined user adjustable level, the control system 14 sends a signal which actuates solenoid 133 which opens valve 132 and allows a predetermined amount of solvent to flow into the ink reservoir.

The fill-spout 125 (FIG. 3) of ink reservoir 12 is sealed by a cap 124. The fill-spout 125 is dimensioned so that the top edge thereof 126 is below the lower surface of plate 18. Through such a construction, ink reservoir 12 cannot be overfilled because the level of ink in the reservoir can never be higher than the upper surface 126 of fill-spout 125.

In operation, ink is maintained within ink reservoir 12. A predetermined level of viscosity is set by the user through control system 14. The viscosimeter 140 produces a signal in response to the viscosity of the ink contained within the ink reservoir 12. This signal is monitored by the control system 14. When the viscosity of the ink contained within ink reservoir 12 falls below the predetermined level, the control system 14 sends a signal which actuates solenoid 133 which opens valve 132 and allows a predetermined amount of solvent to flow into the ink reservoir.

When the pumping system is in operation, the rotation of motor 17 causes pulleys 24 and 25 to rotate. The rotation of pulley 25 drives ink paddle drive pulley 36 by means of belt 37. The rotation of pulley 36 drives shaft 40 which is coupled to shaft 43 to which paddle blades 50 are mounted. The rotation of these paddle blades ensures that the ink and solvent contained within reservoir 12 will remain mixed. Because pulley 36 is larger than pulley 25, shafts 40 and 43 rotate slower than motor drive shaft 20.

The rotation of pulley 24 drives gear pump drive pulley 26 through the use of belt 27. Rotation of pulley 26 drives upper drive pump shaft 30 and lower pump drive shaft 33. The rotation of lower pump drive shaft 33 and drive gear 74 mounted thereon drives driven gear 75 in the opposite direction. The rotation of gears 74 and 75 within pumping chamber 80 causes ink to be pumped from the inlet portion 104 through the inlet chamber 83 to the outlet chamber 84 and into outlet port 90. Once,, in the outlet port 90, the ink flow passes a portion thereof through an opening 97 (FIG. 1) in ink reservoir 12 into an external valve 91 and then through a hose or other conduit (not shown) to a printing location and another portion the ink may pass upward through bypass assembly 92 back into ink reservoir 12. By rotating handle 100, which is mounted on rod 96, clockwise, 96 will travel downward with respect to gear pump 72. Thus the clearance between the tip 95 and tapered seat 94 of valve assembly 92 can be adjusted. Accordingly, the percentage of ink which passes through external valve 91 and the percentage which passes through bypass valve assembly 92 are controlled through the adjustment of bypass flow adjustment rod 96.

It will be understood that the embodiment of the present invention which has been described herein is illustrative of an application of the principles of the invention. Modifications may be made by those skilled in the art without departing from the spirit and scope of the invention.

I claim:

1. In an ink pump system for pump ink comprising:

a frame;

an ink reservoir mounted on said frame having an outlet in said ink reservoir for discharging ink from said reservoir and an inlet for the return of recirculated ink;

an ink solvent reservoir mounted on said frame;

means for transferring solvent from said solvent reservoir to said ink reservoir; and means for controlling the transfer of said solvent to said ink reservoir in order to maintain the ink contained in said ink reservoir at a substantially constant predetermined viscosity;

the improvement comprising:

a seal-less gear pump housing located within said ink reservoir so as to be submerged in the ink contained therein, said pump housing having a fluid pumping chamber therein, an inlet in said chamber communicating with said ink reservoir for admitting ink from said reservoir into said chamber, an outlet from said chamber for discharging ink from said chamber to said outlet in said ink reservoir, a first gear rotatably mounted within said chamber, a second gear rotatably mounted within said chamber in meshing engagement with said first gear, and power input means for driving one of said first and second gears whereby said gears rotate in opposite directions to pump ink through said chamber from said inlet opening to said outlet opening; and wherein said ink reservoir has a sump and said gear pump housing is removably disposed in said sump.

2. In an ink pump system for pumping ink comprising:

a frame;

an ink reservoir mounted on said frame having an outlet in said ink reservoir for discharging ink from said reservoir and an inlet for the return of recirculated ink;

an ink solvent reservoir mounted on said frame;

means for transferring solvent from said solvent reservoir to said ink reservoir; and means for controlling the transfer of said solvent to said ink reservoir in order to maintain the ink contained in said ink reservoir at a substantially constant predetermined viscosity;

the improvement comprising:

a seal-less gear pump housing located within said ink reservoir so as to be submerged in the ink contained therein, said pump housing having a fluid pumping chamber therein, an inlet in said chamber communicating with said ink reservoir for admitting ink from said reservoir into said chamber, an outlet from said chamber for discharging ink from said chamber to said outlet in said ink reservoir, a first gear rotatably mounted within said chamber, a second gear rotatably mounted within said chamber in meshing engagement with said first gear, and power input means for driving one of said first and second gears whereby said gears rotate in opposite directions to pump ink through said chamber from said inlet opening to said outlet opening; and wherein said gear pump housing is closed and includes a cover with said inlet in said fluid pumping chamber located in a depression in the top surface of said cover and a filter screen is disposed in said depression and over said inlet.

3. In an ink pump system for pumping ink comprising:

a frame;

an ink reservoir mounted on said frame having an outlet in said ink reservoir for discharging ink from said reservoir and an inlet for the return of recirculated ink;

an ink solvent reservoir mounted on said frame;

means for transferring solvent from said solvent reservoir to said ink reservoir; and means for controlling the transfer of said solvent to said ink reservoir in order to maintain the ink contained in said ink reservoir at a substantially constant predetermined viscosity;

the improvement comprising:

a seal-less gear pump housing located within said ink reservoir so as to be submerged in the ink contained therein, said pump housing having a fluid pumping chamber therein, an inlet in said chamber communicating with said ink reservoir for admitting ink from said reservoir into said chamber, an outlet from said chamber for discharging ink from said chamber to said outlet in said ink reservoir, a first gear rotatably mounted within said chamber, a second gear rotatably mounted within said chamber in meshing engagement with said first gear, and power input means for driving one of said first and second gears whereby said gears rotate in opposite directions to pump ink through said chamber from said inlet opening to said outlet opening; and wherein said power input means includes an electric motor mounted on said frame having a vertically extending drive shaft with a first pulley mounted thereon, a driven shaft projecting upwardly from one of said first and second gears, a second pulley mounted on said driven shaft, and a drive belt operatively interconnecting said pulleys.

4. In an ink pump system for pumping ink comprising:

a frame;

an ink reservoir mounted on said frame having an outlet in said ink reservoir for discharging ink from said reservoir and an inlet for the return of recirculated ink;

an ink solvent reservoir mounted on said frame;

means for transferring solvent from said solvent reservoir to said ink reservoir; and means for controlling the transfer of said solvent to said ink reservoir in order to maintain the ink contained in said ink reservoir at a substantially constant predetermined viscosity;

the improvement comprising:

a seal-less gear pump housing located within said ink reservoir so as to be submerged in the ink contained therein, said pump housing having a fluid pumping chamber therein, an inlet in said chamber communicating with said ink reservoir for admitting ink from said reservoir into said chamber, an outlet from said chamber for discharging ink from said chamber to said outlet in said ink reservoir, a first gear rotatably mounted with said chamber, a second gear rotatably mounted within said chamber in meshing engagement with said first gear, and power input means driving one of said first and second gears whereby said gears rotate in opposite directions to pump ink through said chamber from said inlet opening to said outlet opening;

wherein said power input means includes an electric motor mounted on said frame having a vertically extending drive shaft with a first pulley mounted thereon, a driven shaft projecting upwardly from on of said first and second gears, a second pulley mounted on said driven shaft, and a drive belt operatively interconnecting said pulleys; and wherein an ink agitator paddle having a vertical drive shaft is mounted for rotation on its vertical axis in said reservoir, a third drive pulley is mounted on said motor drive shaft, a fourth drive pulley is mounted on said ink agitator paddle drive shaft, and a second drive belt operatively interconnects said third and fourth drive pulleys.

5. In an ink pump system for pumping ink comprising:

a frame;

an ink reservoir mounted on said frame having an outlet in said ink reservoir for discharging ink form said reservoir and an inlet for the return of recirculated ink;

an ink solvent reservoir mounted on said frame;

means for transferring solvent from said solvent reservoir to said ink reservoir; and means for controlling the transfer of said solvent to said ink reservoir in order to maintain the ink contained in said ink reservoir at a substantially constant predetermined viscosity;

the improvement comprising:

a seal-less gear pump housing located within said ink reservoir so as to be submerged in the ink contained therein, said pump housing having a fluid pumping chamber therein, an inlet in said chamber communicating with said ink reservoir for admitting ink from said reservoir into said chamber, an outlet from said chamber for discharging ink from said chamber to said outlet in said ink reservoir, a first gear rotatably mounted within said chamber, a second gear rotatably mounted within said chamber in meshing engagement with said first gear ,and power input means for driving one of said first and second gears whereby said gears rotate in opposite directions to pump ink through said chamber from said inlet opening to said outlet opening; and wherein said gear pump housing is closed and includes a cover in which there is a second ink discharging outlet and said second outlet communicates between the interior of said chamber and the interior of said reservoir, and adjustable means for regulating the effective size of second outlet whereby a desired portion of the ink discharging from said chamber is diverted through said second outlet while the remainder discharges through said first-mentioned outlet from said chamber.

6. The improved ink pump system called for in claim 5 wherein said second outlet is a tapered opening located in said cover, and said adjustable means is a vertically adjustable rod having an exposed manipulating handle on its upper end and a tapered bottom end which projects into said second outlet and forms an adjustable orifice therewith.

7. The improved ink pump system called for in claim 4 wherein restricted bypass passageways are provided which allow ink to bypass said first and second outlets in the event said first and second outlets are inadvertently closed.

8. The improved ink pump system called for in claim 6 wherein one of said restricted passageways extends through the bottom wall of said pump housing in communication with said first-mentioned outlet and another one of said restricted passageways extends through said bottom wall in communication with the inlet side of said pump, and said restricted passageways communicate with each other through a passageway on the exterior of said pump housing.

9. In an ink pump system for pumping ink comprising:

a frame; an an ink reservoir mounted on said frame having outlet in said ink reservoir for discharging ink from said reservoir and an inlet for the return of recirculated ink;

an ink solvent reservoir mounted on said frame;

means for transferring solvent from said solvent reservoir to said ink reservoir; and means for controlling the transfer of said solvent to said ink reservoir in order to maintain the ink contained in said ink reservoir at a substantially constant predetermined viscosity;

the improvement comprising:

a seal-less gear pump housing located within said ink reservoir so as to be submerged in the ink contained therein, said pump housing having a fluid pumping chamber therein, an inlet in said chamber communicating with said ink reservoir for admitting ink from said reservoir into aid chamber, an outlet from said chamber for discharging ink from said chamber to said outlet in said ink reservoir, a first gear rotatably mounted within said chamber, a second gear rotatably mounted within said chamber in meshing engagement with said first gear, and power input means for driving one of said first and second gears whereby said gears rotate in opposite directions to pump ink through said chamber from said inlet opening to said outlet opening; and wherein each of said first and second gears has shaft projections on the top and bottom thereof, said housing has a pair of journal sockets in its bottom wall for journaling said bottom projections, said housing has a cover plate with a pair of journal openings therein for journaling said top projections, the bottom of said housing has a first channel therein communicating between said journal sockets, and said cover plate has a second channel therein communicating between said journal openings, said first and second channels allowing ink to be forced against both the undersides and top sides of said gears so as to self-lubricate the same during pumping.

10. The improved ink pump system called for in claim 9 wherein said first channel is in the form of a shallow groove in the inner surface of the bottom wall of said housing and said second channel is in the form of a shallow groove in the bottom surface of said cover plate.

* * * * *

UNITED STATES PATENT AND TRADEMARK OFFICE

CERTIFICATE OF CORRECTION

PATENT NO. : 4,792,292

DATED : December 20, 1988

INVENTOR(S) : Reinhard Gaenzle

It is certified that error appears in the above-identified patent and that said Letters Patent is hereby corrected as shown below:

Column 11, claim 7, line 2 thereof, "4" should read "5".

Column 11, claim 8, line 2 thereof, "6" should read "7".

Column 11, last line, delete --an--.

Column 12, line 18, "aid" should read "said".

Signed and Sealed this

Third Day of April, 1990

*Attest:*

HARRY F. MANBECK, JR.

*Attesting Officer*

*Commissioner of Patents and Trademarks*